US008207866B2

(12) United States Patent
Hatami

(10) Patent No.: US 8,207,866 B2
(45) Date of Patent: Jun. 26, 2012

(54) AUDIBLE DRIVING ALERT

(76) Inventor: Naquib U. Hatami, Bristow, VA (US)

( * ) Notice: Subject to any disclaimer, the term of this patent is extended or adjusted under 35 U.S.C. 154(b) by 437 days.

(21) Appl. No.: 12/503,287

(22) Filed: Jul. 15, 2009

(65) Prior Publication Data

US 2011/0012754 A1 Jan. 20, 2011

(51) Int. Cl.
*G08G 1/09* (2006.01)

(52) U.S. Cl. ..... 340/905; 340/995.13

(58) Field of Classification Search ..... 340/905, 340/995.1, 995.13, 438, 901; 701/117, 210
See application file for complete search history.

(56) References Cited

U.S. PATENT DOCUMENTS

| | | | | |
|---|---|---|---|---|
| 7,027,915 | B2 * | 4/2006 | Craine | 701/117 |
| 7,135,961 | B1 * | 11/2006 | Operowsky et al. | 340/425.5 |
| 7,609,172 | B2 * | 10/2009 | Rozum et al. | 340/901 |
| 7,739,036 | B2 * | 6/2010 | Grimm et al. | 701/208 |
| 2009/0224942 | A1 * | 9/2009 | Goudy et al. | 340/905 |

* cited by examiner

*Primary Examiner* — Toan N Pham
(74) *Attorney, Agent, or Firm* — James A. Italia; Italia IP

(57) ABSTRACT

A system for advising the operator of a transportation vehicle to impending travel conditions responsive to proximity to the area affected by the travel conditions. The system has location determination capability such as a GPS system and a source of travel condition advisory messages. When a travel condition advisory message is received and the vehicle is in the affected area, an audible signal is delivered within the transportation vehicle. Apparatus of the system may be self-contained and located aboard the transportation vehicle or alternatively may comprise message transmission apparatus located externally of the transportation vehicle.

6 Claims, 2 Drawing Sheets

AUDIBLE DRIVING ALERT

FIELD OF THE INVENTION

The present invention pertains to communications systems for transportation vehicles, and more particularly to automatically generated advisory messages which produce an audible signal in a vehicle. Location of the vehicle is a key factor in generating the advisory messages.

BACKGROUND OF THE INVENTION

The operator of a transportation vehicle such as a wheeled motor vehicle being operated on public roads for example may unbeknownst to him or her be approaching an area which will present certain hardships. For example, the area may be congested and will therefore impede the operator's progress. Alternatively, the area may have speed limits below those to which the operator has become accustomed. Still alternatively, the area may be subject to construction, an accident, or other interferences with driving. A particular stretch of roadway may have an inherent hazard such as extreme curves, may be subject to slippery conditions, or other hazards.

Warning systems for drivers exist. However, it would be desirable to generate an audible signal of impending potential problem areas as the operator gets close to these, as a visual signal may not be noticed due to driver attention to the road, or alternatively may cause the driver to break concentration or attention to the road.

SUMMARY OF THE INVENTION

The present invention sets forth a system wherein an audible signal is provided to the operator of a vehicle responsive to location of the vehicle. The audible signal is indicative of a condition which will potentially affect the vehicle or its operation.

Location may be determined for example by a Global Positioning System (hereinafter referred to in abbreviated form as GPS) system, although other methods may be used.

This feature is incorporated into a system for delivering predetermined messages. For example, a vehicular navigation system may have data loaded thereinto pertaining to speed limits. When a vehicle equipped with such a system enters or approaches an area of different speed limits, the system may trigger an automatic signal which is presented to the operator or other occupant of the vehicle in at least audible form.

BRIEF DESCRIPTION OF THE DRAWINGS

Similar reference characters denote corresponding features consistently throughout the attached drawings.

DETAILED DESCRIPTION

The present invention provides an advisory system for providing an audible signal to the operator of a transportation vehicle, wherein the audible signal is indicative of a potentially significant travel condition which may affect operation of the transportation vehicle. The audible signal may be the only indication of an indicated condition or alternatively may supplement a visible signal, vibratory or other tactile signal. The transportation vehicle (not shown) may be for example a passenger vehicle licensed to drive on public roadways, such as a privately owned automobile or truck, or a vehicle available to the general public for commercial transportation services, such as a bus or a taxi. The transportation vehicle may of course also be an aircraft or boat.

Figure 1:
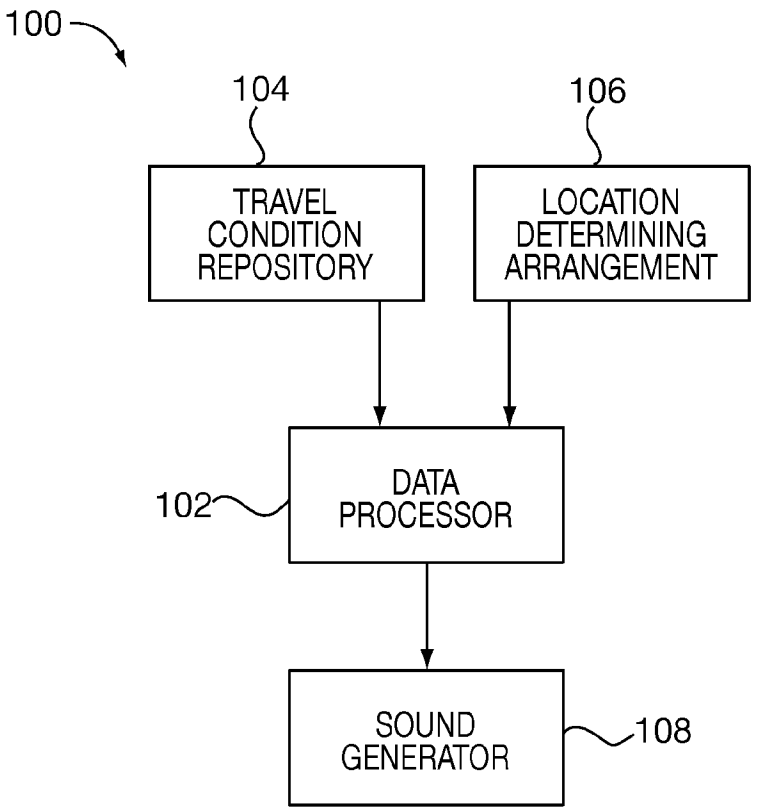
FIG. 1 shows in block diagram format functional components of an advisory system according to one aspect of the invention, wherein the advisory system is entirely self-contained aboard a transportation vehicle.

FIG. 1 shows functional aspects of an advisory system 100 which is substantially self-contained within a transportation vehicle (not shown). A data processor 102 is connected to a travel condition repository 104 and to a location determining arrangement 106 so as to be able to receive inputs therefrom. The travel condition repository 104 may comprise for example a digital compilation of potential conditions which may be annunciated to the operator or other occupants of the transportation vehicle which may be integral with or separate from the data processor 102. The location determining arrangement 106 may comprise for example a GPS enabled device which is capable of receiving signals from GPS satellites and responsively generating data indicative of location. The GPS enabled device may be a dedicated device or subsystem provided specifically for and as part of the advisory system 100 or alternatively may comprise a device or subsystem which may for example be provided as part of the transportation vehicle without it having been contemplated that the GPS enabled device would be used as part of the novel system.

The data processor 102 may process inputs from both the travel condition repository 104 and the location determining arrangement 106 so that when the transportation vehicle is within a predetermined proximity to geographic areas associated with a stored travel condition or a stored potential condition, the data processor 102 transmits advisory messages as advisory signals which are indicative of any travel condition of the type to be conveyed to occupants of the transportation vehicle. Advisory signals are transmitted to a sound generator 108 located within hearing proximity of the occupant of the transportation vehicle who is intended to receive the signal, such as a driver or other operator.

The sound generator 108 may comprise a dedicated device which emits sounds responsive to advisory signals, or alternatively may comprise a multi-purpose device such as a radio or other audible device (not separately shown) which may be for example part of an entertainment system or announcement system provided as part of the transportation vehicle. Audible signals generated by sound generator 108 responsive to the data processor 102 may comprise tones, synthetic or pre-recorded speech, or both, or may take still other forms. Where the sound generator 108 is part of a system having a purpose other than just annunciation of travel conditions, the audible signals may be emitted simultaneously with other sounds such as music being produced by the sound generator 108 or may temporarily interrupt the other sounds for exclusive production of the audible signals pertaining to the travel conditions.

Figure 2:
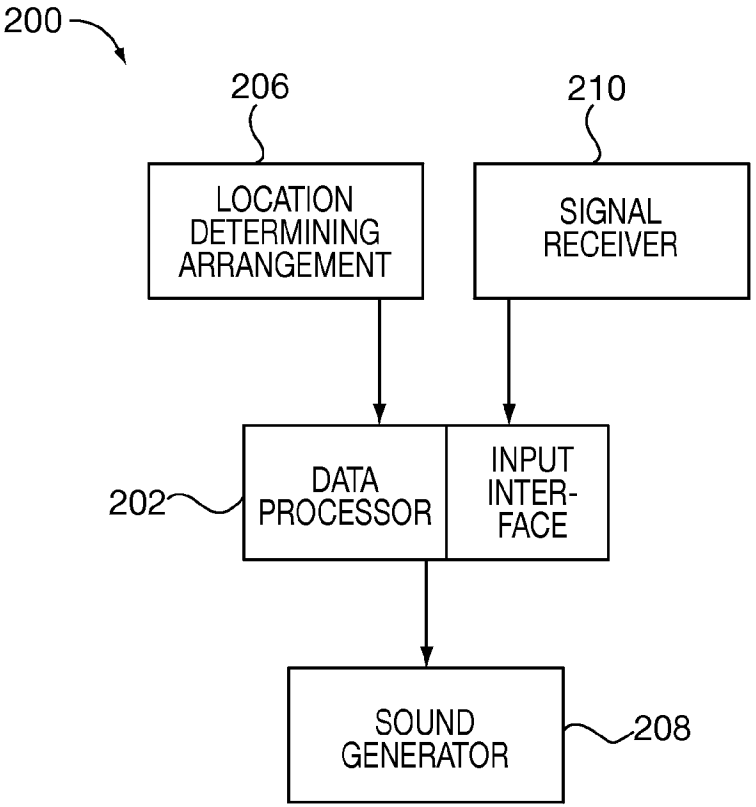
FIG. 2 shows in block diagram format functional components of an advisory system according to one aspect of the invention, wherein the advisory system is partially contained aboard a transportation vehicle and also includes apparatus remote from the transportation vehicle.

FIG. 2 shows an advisory system 200 which can produce results or outputs similar to those of the advisory system 100, but which advisory system 200 is not substantially self-contained aboard the transportation vehicle. The advisory system

200 may comprise a data processor 202, a location determining arrangement 206, and a sound generator 208 any or all of which may be structurally and functionally similar to their like named counterparts of FIG. 1. Both the data processor 102 and the data processor 202 will be understood to comprise data storage capability which is able to be loaded with data pertaining to travel conditions. The difference is that the advisory system 100 is self-contained and located entirely within its associated transportation vehicle.

Unlike the advisory system 100, the advisory system 200 may have capability of receiving from external sources certain operating signals. For example, the advisory system 200 may comprise a signal receiver 210 which may be a radio frequency receiver, or which may operate according to mobile telephone protocols, or other mobile communications devices for example. The signal receiver 210 may transmit received signals to an input interface 212 disposed in communication with the data processor 202. The input interface 212 may for example convert radio frequency or other communications signals into digital signals of the type which may be digitally processed by the data processor 202.

In the advisory system 100, travel conditions may be stored within the travel condition repository 104. By contrast, in the advisory system 200, corresponding travel conditions may be communicated from a remote location such as a stationary or mobile central station (not shown). The central station may emit radio frequency or other signals which are received by the signal receiver 210 for example. The signal receiver 210 may communicate wirelessly with the internet, with signals being broadcast on the internet. For example, the advisory system 200 may comprise programming disposed to receive data corresponding to travel conditions automatically when passing through a geographic area provided with wireless internet service. Regardless of the source of signals of travel conditions, the advisory system 200 may rely upon an external source of data regarding travel conditions, and not have to store this information internally as may be done in the advisory system 200. An advantage of the advisory system 200 is that the data storage capability is able to be provided with updated data pertaining to travel conditions, whereby the data storage capability may be maintained such that the stored data reflects updated, current travel conditions. The advisory system 200 may therefore be understood to comprise a radio frequency transmitter disposed to transmit the advisory messages by radio frequency, even where the radio frequency transmitter is remote from the transportation vehicle provided with the advisory system 200.

Regardless of whether an advisory system according to at least one aspect of the invention is self-contained or may utilize external travel condition signals, it may be considered to comprise a travel condition monitoring system disposed to store and transmit advisory messages as advisory signals indicative of a travel condition which actively affects operation of transportation vehicles and which pertain to a predetermined geographic area, among other components. As employed herein, "actively affecting" operation of transportation vehicles signifies that under almost all circumstances, at least one characteristic of operation of the transportation vehicle will be modified responsively to the annunciated condition. Illustratively, speed may be slowed, a lane may be changed, an unplanned turn may be made, signal or general illumination lighting may be operated, windshield wipers may be activated, automatic systems such as cruise control may be deactivated or overridden, or other steps may be undertaken which steps would not be necessary or advisable in the absence of such warning. It should be mentioned here that for the purposes of the present invention, travel conditions encompass many different situations, each of which may impact actively on how the transportation vehicle is to be driven. These conditions may include but not be limited to restrictions as to lane usage, such as restriction to vehicles carrying a mandated minimum number of occupants; places where a vehicle is required to stop or to yield; speed limit changes; limitation of traffic lanes for turning or other purposes; directional control such as roads designated for one-way use; existence of structure such as divided highways, or highways bearing islands or other separation of travel lanes; parking regulations; changes in road usage due to emergency vehicles and like factors; usage of vehicles of significantly different character than frequently encountered motor vehicles, such as bicycles, pedestrian traffic, horse drawn vehicles, vehicles which by their nature are more limited in speed than are most vehicles, and the like; existence of traffic signals; road closures, both permanent and temporary; limitations on gross vehicle weights, and of stations for checking vehicle weights; exclusionary restriction of traffic, such as prohibitions against trucks; presence of railway and light rail facilities; requirements for seatbelt use; turns and curves; presence of impending intersections; presence of special or unusual traffic control, such as by foot patrolmen; merging or other lane transitions; variation in lane width; lane separation conditions such as divided highways, notable conditions of road surfaces, such as temporary disrepair or distress, such as milling in preparation of repaving and potholes; pedestrian and animal crossings of the roadway; unusually low overhead clearances; suggested if not mandated speed limitations; dead ends and other lack of access or passage; restrictions on passing; recreational, school facilities, and other facilities where children may be present; speed humps; areas where traffic is forbidden; roadway construction or repair projects; areas wherein explosives are being used; areas of slow traffic, where this is either a permanent or transient condition, and the like.

It should be understood that an advisory system such as the advisory system 100 or the advisory system 200 need not be limited to identifying and communicating only one condition. Rather, an advisory system according to at least one aspect of the invention may be disposed to transmit advisory messages pertaining to at least two dissimilar travel conditions, such as for example any two or more of the traffic conditions listed above. Moreover, a data processor such as the data processor 102 or the data processor 202 may be capable of identifying different travel conditions and may be employed to issue different annunciation signals for each one of the different travel conditions which may be identified as being present. Accordingly, a sound generator such as the sound generator 108 or the sound generator 208 may be disposed to emit audible signals of different auditory characteristics corresponding to the different annunciation signals. For example, sound volume, pitch, and other sound characteristics may be varied to emphasize one or more traffic conditions according to predetermined urgency or severity of the annunciated condition.

The invention may be thought of as a travel condition annunciating system carried aboard the transportation vehicle for receiving advisory signals corresponding to advisory messages which are transmitted by the travel condition monitoring system. Such a travel condition annunciating system may comprise a location determining arrangement disposed to determine location of the transportation vehicle, such as the location determining arrangement 106 and a signal receiver disposed to receive advisory signals transmitted by the travel condition monitoring system. The apparatus of the travel condition annunciating system may be so integrated that the signal receiver may comprise a data processor a data processor disposed to issue an annunciation signal indicative of the travel condition communicated by the travel condition monitoring system, such as the data processor 102 and its software. The travel condition annunciating system may comprise a sound generator disposed to emit an audible signal within the transportation vehicle, such as the sound generator 108. The data processor may be disposed, when at least one advisory message transmitted by the travel condition monitoring system is received by the signal receiver, to conduct a comparison between the received travel condition signal and determination of location and to generate an advisory message when two conditions are present simultaneously. That is, there exists a travel condition which meets a predetermined threshold deemed necessary or desirable to annunciate, and also the transportation vehicle is of predetermined critical proximity to the geographic area to which the advisory message pertains.

Figure 3:
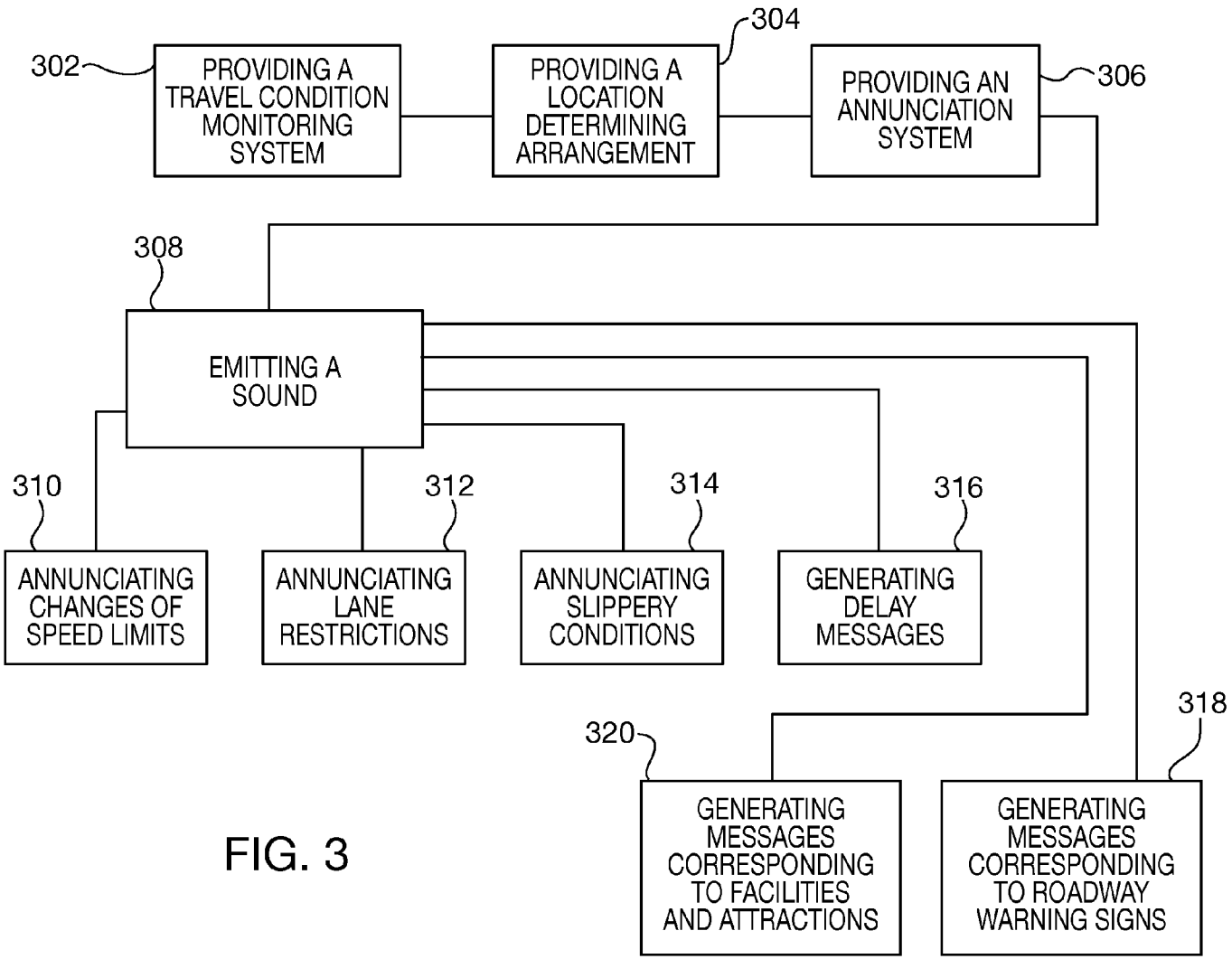
FIG. 3 is a block diagram of steps of a method of alerting the operator of a transportation vehicle of a potentially significant travel condition, wherein the step are summarized in the block diagram.

The invention may also be thought of as a method 300 of alerting the operator of a transportation vehicle of a potentially significant travel condition. Referring to FIG. 3, the method 300 may comprise a step 302 of providing a travel condition monitoring system disposed to store and transmit advisory messages as advisory signals indicative of a travel condition which may affect transportation vehicles and which pertain to a predetermined geographic area; a step 304 of providing a location determining arrangement disposed to determine location of the transportation vehicle; a step 306 of providing aboard a transportation vehicle a travel condition annunciating system for receiving advisory signals corresponding to advisory messages which are transmitted by the travel condition monitoring system and a sound generator; and a step 308 of causing the sound generator to emit a sound within the transportation vehicle automatically and responsively to the travel condition monitoring system transmitting at least one advisory message indicative of a travel condition which actively affects vehicle operation when the location determining arrangement determines that the vehicle is within a predetermined proximity of the geographic area to which the advisory message pertains.

The method 300 may comprise a step 310 of monitoring official speed limits and annunciating changes of official speed limits on the road being negotiated by the transportation vehicle.

The method 300 may comprise a step 312 of monitoring establishment of lane restrictions which may restrict use of at least one lane by a particular transportation vehicle and generating advisory messages annunciating lane restrictions on the road being negotiated by the transportation vehicle.

The method 300 may comprise a step 314 of monitoring roadways for transient slippery conditions which have been identified and signaled by governmental authorities responsible for the monitored roadways, and generating advisory messages annunciating transient slippery conditions which have been identified and signaled by the governmental authorities.

The method 300 may comprise a step 316 of monitoring progress of traffic on the monitored roadways, determining expected progress of traffic on the monitored roadways, and generating advisory delay messages when monitored progress of traffic is less than expected progress of traffic. This may be accomplished for example by receiving inputs from municipal authority broadcasts for example, announcing delays or reporting a rate of average speed of traffic. Such inputs may be received for example using the signal receiver 210 of FIG. 2. A data processor such as the data processor 202 may compare reported average speed with predetermined speed limits, and upon detecting a discrepancy indicative of delay, may responsively generate an advisory message of less than expected progress.

A travel condition monitoring system according to at least one aspect of the present invention may monitor roadway warning signs which have been posted by governmental authorities responsible for the monitored roadways. The method 300 may accordingly comprise a step 318 of generating advisory messages corresponding to the roadway warning signs.

A travel condition monitoring system according to at least one aspect of the present invention may monitor the roadway for proximity to recreational and cultural facilities, and historical and geographic attractions which may be accessed from the monitored roadway. The method 300 may accordingly comprise a step 320 of generating advisory messages corresponding to the recreational and cultural facilities and the historical and geographic attractions.

The steps presented herein are not limited to the order and combination described herein. These steps may be practiced in any feasible order and in any feasible combination wherein steps are retained or omitted to suit.

Where employed herein, references to plural signals and messages is meant in a semantic sense. A single signal or a single message may actually be generated or utilized by a system according to the invention.

An advisory system according to at least one aspect of the invention may comprise a combination of internal and external sourcing of travel condition data if desired. For example, a portion of such a system may comprise a preloaded memory supplemented or updated by information received subsequently, such as by a signal receiver such as the signal receiver 210.

While the present has been described in connection with what is considered the most practical and preferred embodiments, it is to be understood that the present invention is not to be limited to the disclosed arrangements, but is intended to cover various arrangements which are included within the spirit and scope of the broadest possible interpretation of the appended claims so as to encompass all modifications and equivalent arrangements which are possible.

I claim:

1. A method of alerting the operator of a transportation vehicle of a potentially significant travel condition, comprising the steps of:

providing a travel condition monitoring system disposed to store and transmit advisory messages as advisory signals indicative of a travel condition which may affect transportation vehicles and which pertain to a predetermined geographic area;

providing a location determining arrangement disposed to determine location of the transportation vehicle;

providing aboard a transportation vehicle a travel condition annunciating system for receiving advisory signals corresponding to advisory messages which are transmitted by the travel condition monitoring system and a sound generator; and causing the sound generator to emit a sound within the transportation vehicle automatically and responsively to the travel condition monitoring system transmitting at least one advisory message indicative of a travel condition which actively affects vehicle operation when the location determining arrangement determines that the vehicle is within a predetermined proximity of the geographic area to which the advisory message pertains, wherein the travel condition monitoring system monitors establishment of lane restrictions which may restrict use of at least one lane by a particular transportation vehicle and generates advisory messages annunciating lane restrictions on the road being negotiated by the transportation vehicle.

2. The method of claim 1, wherein the travel condition monitoring system monitors official speed limits and generates advisory messages annunciating changes of official speed limits on the road being negotiated by the transportation vehicle.

3. The method of claim 1, wherein the travel condition monitoring system monitors roadways for transient slippery conditions which have been identified and signaled by governmental authorities responsible for the monitored roadways, and generates advisory messages annunciating transient slippery conditions which have been identified and signaled by the governmental authorities.

4. The method of claim 1, wherein the travel condition monitoring system monitors progress of traffic on the monitored roadways, has means for determining expected progress of traffic on the monitored roadways, and generates advisory messages when monitored progress of traffic is less than expected progress of traffic.

5. The method of claim 1, wherein the travel condition monitoring system monitors roadway warning signs which have been posted by governmental authorities responsible for the monitored roadways and generates advisory messages corresponding to the roadway warning signs.

6. The method of claim 1, wherein the travel condition monitoring system monitors the roadway for proximity to recreational and cultural facilities, and historical and geographic attractions which may be accessed from the monitored roadway, and generates advisory messages corresponding to the recreational and cultural facilities and the historical and geographic attractions.

* * * * *